US005347775A

United States Patent [19]

Santos

[11] Patent Number: 5,347,775

[45] Date of Patent: Sep. 20, 1994

[54] HURRICANE SHUTTERS FOR WINDOWS

[76] Inventor: Jorge Santos, 2234 W. 8th Ct., Hialeah, Fla. 33010

[21] Appl. No.: 97,212

[22] Filed: Jul. 27, 1993

[51] Int. Cl.[5] ..... E06B 3/26

[52] U.S. Cl. ..... 52/202; 49/460; 49/463

[58] Field of Search ..... 52/202, 203; 49/57, 49/61, 55, 460, 463

[56] References Cited

U.S. PATENT DOCUMENTS 3,745,704 7/1973 Covington ..... 49/463 X 4,685,261 8/1987 Seaquist ..... 49/463 X

*Primary Examiner*—Carl D. Friedman

*Assistant Examiner*—Creighton Smith

*Attorney, Agent, or Firm*—J. Sanchelima

[57] ABSTRACT

This system protects any aperture from inclement weather. The device includes top and bottom rail means which hold a shutter cover means in place. The top rail means includes an elongated channel member that receives the top of the shutter cover means and first and second top sliding carrier means. The bottom rail means includes a flat punched bar member, which supports the weight of the shutter cover means, and has holes to receive a plurality of shutter pin means for cooperatively securing the shutter cover means to the bottom rail means.

8 Claims, 3 Drawing Sheets

HURRICANE SHUTTERS FOR WINDOWS

II. BACKGROUND OF THE INVENTION

1. Field of the Invention.

The present invention relates to aperture coverings, and more particularly, to shutters to cover building apertures.

2. Description of the Related Art.

Applicant believes that the closest reference corresponds to U.S. Pat. No. 4,754,585 issued to John R. Rundo. However, Rundo differs from the present invention because it discloses an energy saving system designed to create a dead air space between an existing window and window frame, and a piece of glazed glass. Rundo also discloses a series of compression clips, which are installed around the edge of the existing window. The compression clips are designed to hermetically seal a second glazed window and seal device against a preexisting window.

Rundo does not suggest upper and lower railings which cooperatively hold an unbreakable shutter against the exterior of a building's apertures. Nor does the prior art suggest a method for easily attaching and removing shutters to a building's apertures.

Other patents describing the closest subject matter provide for a number of more or less complicated features that fail to solve the problem in an efficient and economical way. None of these patents suggest the novel features of the present invention.

III. SUMMARY OF THE INVENTION

It is one of the primary objects of the present invention to provide a shutter to protect building apertures from inclement weather.

It is another object of the present invention to provide shutter system that is easily installed and removed.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 2:
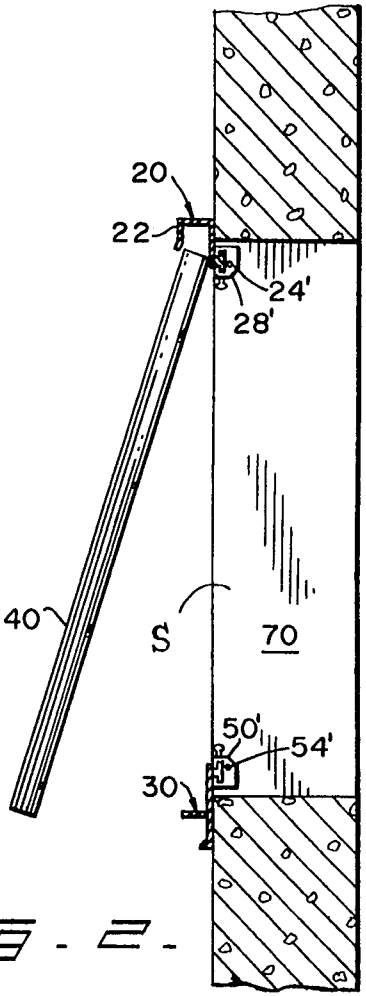
FIG. 2 shows the shutter member being installed between the top and bottom rail assemblies.
Figure 1:
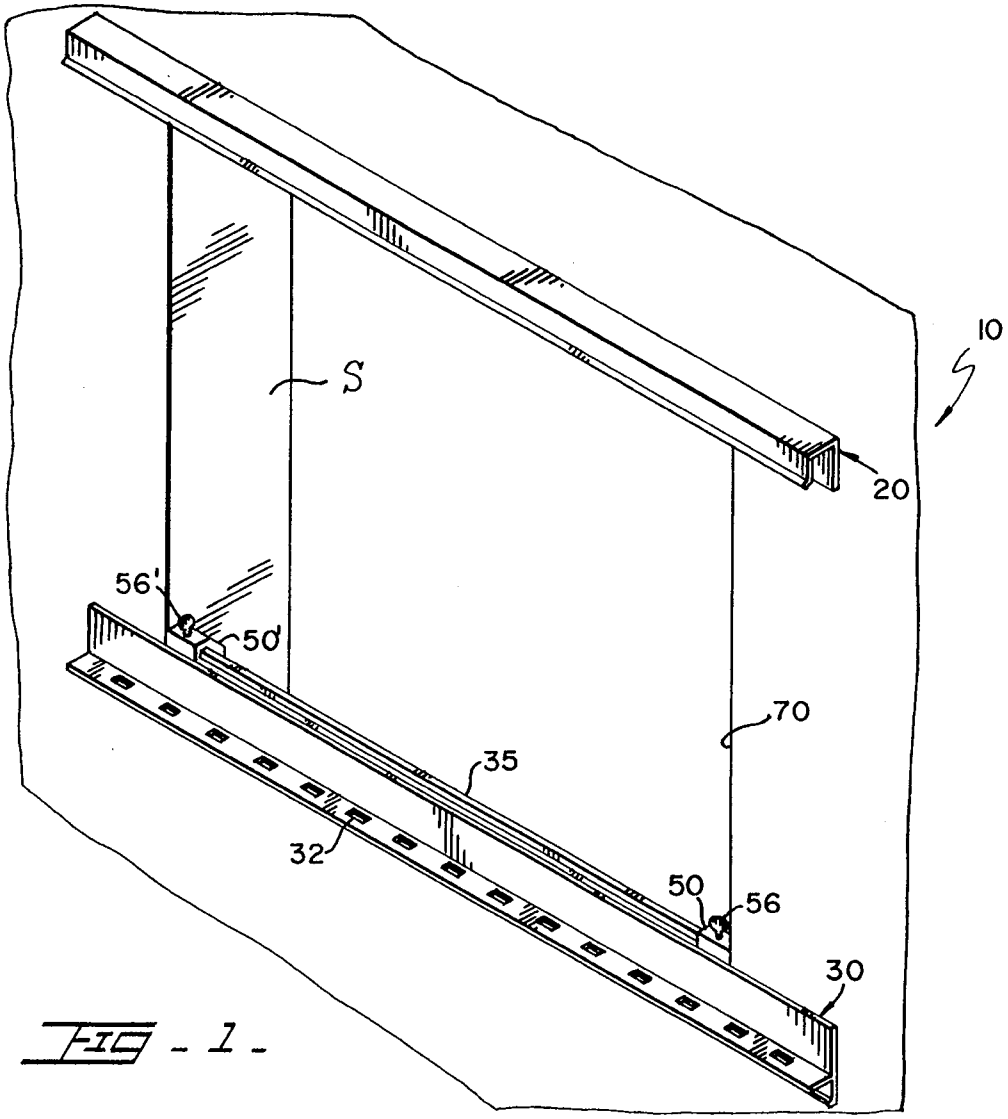
FIG. 1 depicts the top and bottom rail assemblies of the present invention installed at the top and bottom of an aperture.

Referring now to FIGS. 1 and 2, where the present invention is generally referred to with numeral 10, it can be observed that it basically includes top rail assembly 20, bottom rail assembly 30 and shutter cover member 40. Device 10 can protect any building aperture 70 from inclement weather or flying objects. Shutter cover member 40 can be any height. In the preferred embodiment, shutter 40 should be cut to size so that shutter 40 is only slightly larger than the aperture 70.

Figures 3, 4, 5:
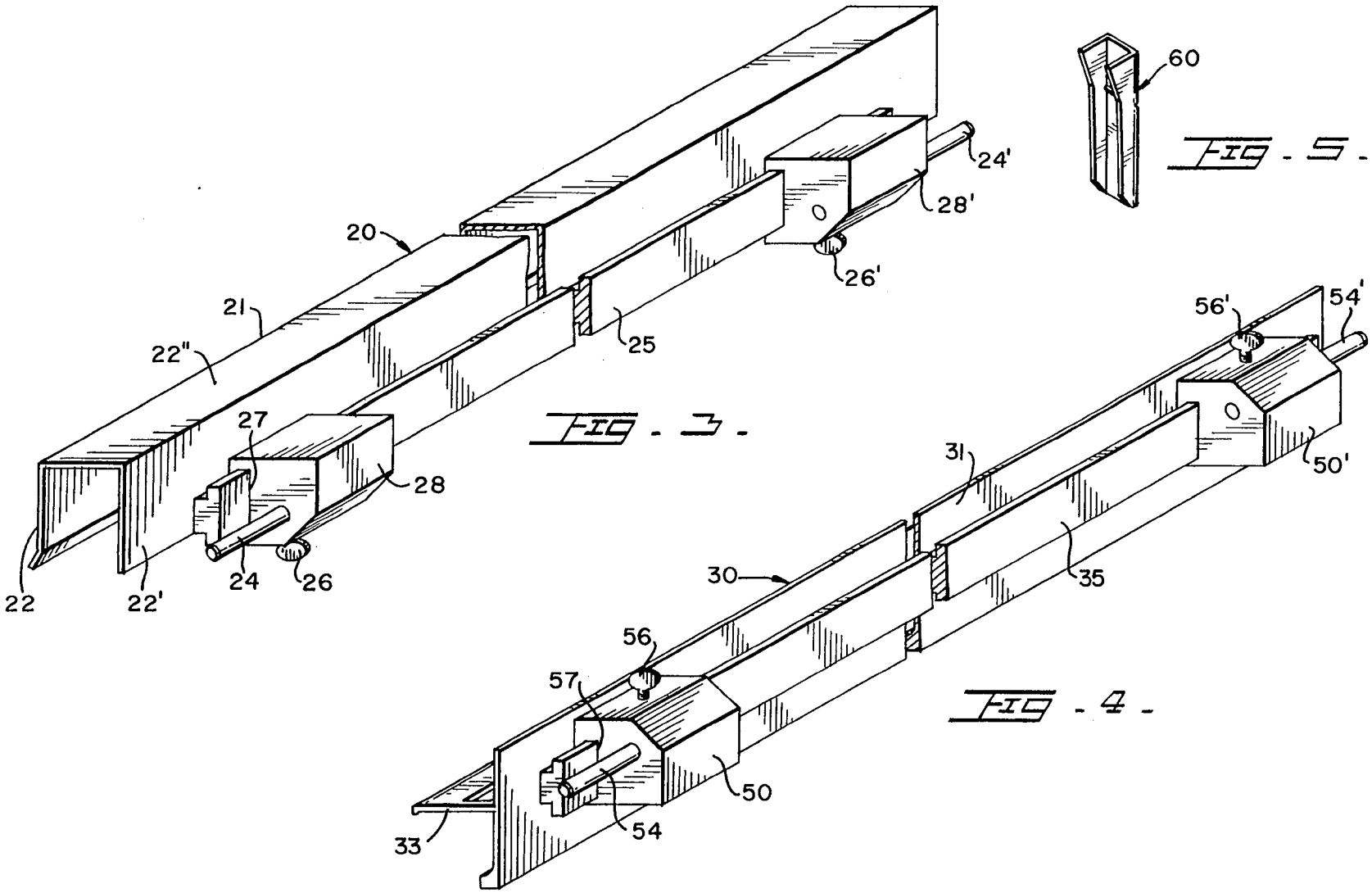
FIG. 3 illustrates the top rail assembly of the present invention.
FIG. 4 is a representation of the bottom rail assembly of the present invention.
FIG. 5 depicts a shutter pin member.

As shown in FIGS. 1, 2 and 5, it is apparent that shutter cover member 40 is cooperatively held in place by top rail assembly 20 and bottom rail assembly 30. The weight of shutter cover member 40 is supported by bottom rail assembly 30.

As shown in FIGS. 1 and 3, it is apparent that top rail assembly 20 includes elongated channel member 21 having elongated side wall members 22 and 22' kept parallel and spaced apart from one another by elongated top wall member 22''. Elongated T-guide member 25 is rigidly mounted to member 22' and is cooperatively received by slot 27 of sliding carrier 28. Carrier 28 includes pin member 24 mounted to carrier 28 extending parallel and in a spaced apart relationship to wall member 22'. Locking thumb screw 26 permits a user to secure carrier 28 in place with respect to elongated T-guide member 25.

Figures 6, 7:
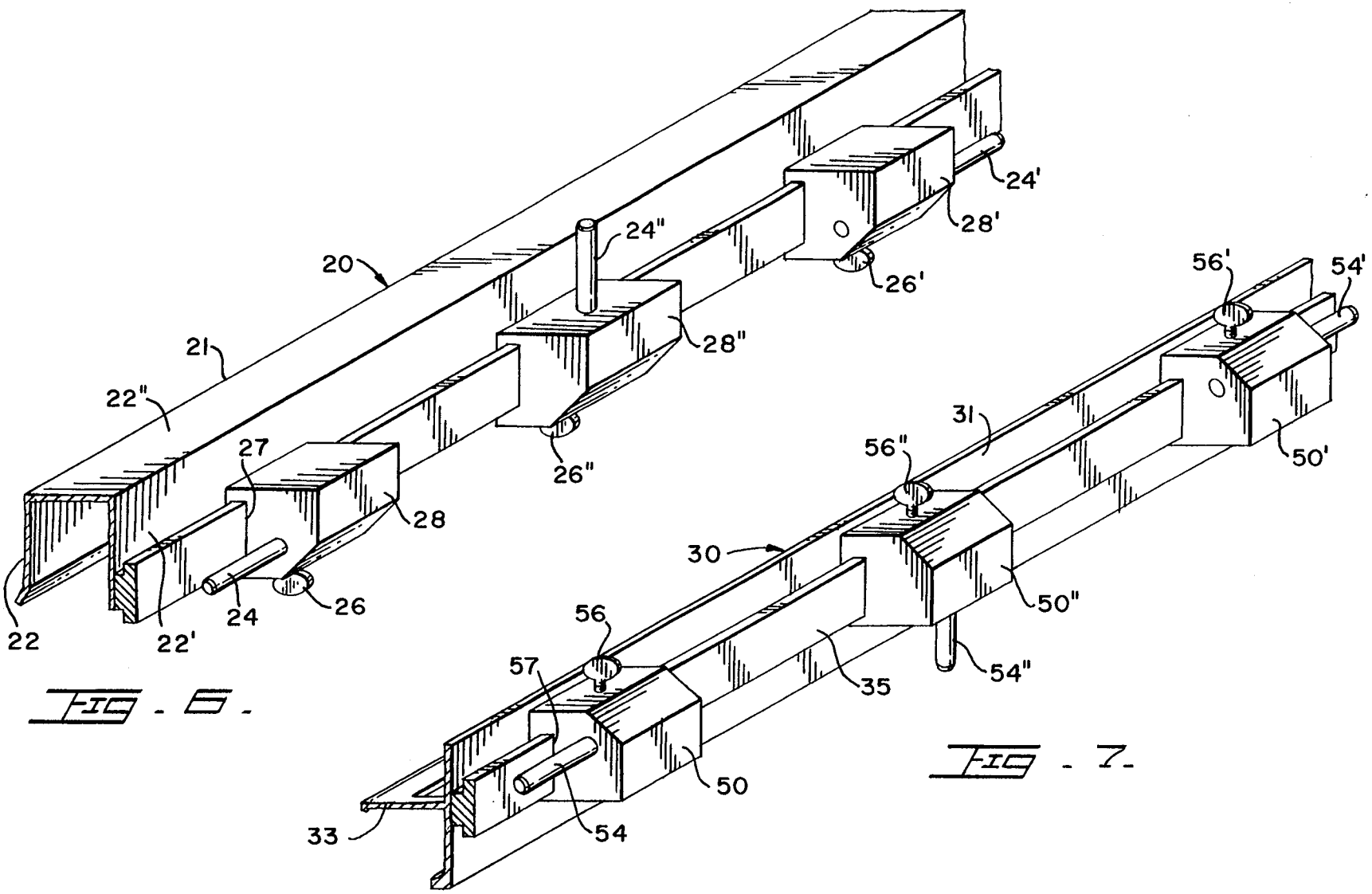
FIG. 6 shows a top rail assembly with additional carrier means slidably mounted thereon.
FIG. 7 depicts a bottom rail assembly with additional carrier means slid ably mounted thereon.

As can best be seen in FIGS. 1, 2 and 6, if a user desires to protect an aperture which is particularly wide it is advisable to attach the top rail assembly 20 to aperture 70 with additional slide carriers 28'' that are cooperatively mounted on elongated T-guide member 25. Carrier 28'' includes pin member 24'' mounted to carrier 28'' extending perpendicular in a spaced apart relationship to wall member 22'. Locking thumb screw 26'' permits a user to secure carrier 28'' in place with respect to T-guide member 25.

Referring now to FIGS. 1 and 4, it can be seen that bottom rail assembly 30 includes elongated flat bar member 31 having elongated punched flat bar member 33 mounted perpendicularly thereto along its entire length on one of the sides of member 31. The opposite side of member 31 includes elongated T-guide member 35 which is similar to member 25 described above. Sliding carrier 50, like carrier 28 above, includes slot 57 that cooperatively receives member 35. Locking thumb screw 56 permits a user to secure carrier 50 in place with respect to member 35. Pin member 54, like member 24, extends longitudinally from carrier 50 and parallel to flat bar member 31. Sliding carrier 50' includes pin member 54' mounted to carrier 50'. Bottom railing assembly 30 also includes locking thumb screw 56' which permits a user to secure carrier 50' in place with respect to elongated T-guide member 35.

As can best be seen in FIGS. 1, 2 and 7, if a user desires to protect an aperture which is particularly wide it is advisable to attach the bottom carrier to aperture 70 with additional carriers 50'' that are cooperatively mounted on elongated T-guide member 35. Carrier 50'' includes pin 54'' mounted to carrier 50'' extending perpendicular and in a spaced apart relationship to member 31. Locking thumb screw 56'' permits a user to secure carrier 50'' in place with respect to T-guide members 35.

In the preferred embodiment, top rail assembly 20 and bottom rail assembly 30 are made of steel, however, any material which is sturdy enough to resist inclement weather and flying debris is suitable.

Shutter cover member 40 is typically a flat rectangular board with four sides, and dimensions that are compatible with the building aperture to be protected. At least two of the four sides need to be straight and parallel with respect to one another. One of these two sides will be inserted inside elongated channel member 21 as best seen if FIG. 2. The other side will rest on punched flat bar member 33. Shutter pins 60 have substantially a wedge shape and are partially received by punched holes 32 in bar member 33 thereby securing shutter cover member 40 against aperture 70.

To install top rail assembly 20, a user must first drill holes on the opposing frame sides S of aperture 70. These holes will cooperatively receive pin members 24 and 24'. The best way of installing top rail assembly 20 will be to pre-set carrier 28 along member 25 and adjust assembly 28 so that pin member 24 is entirely inserted into one of the holes drilled in the upper section of the aperture 70 frame. Then, wall member 22' is brought flush against the upper exterior face of aperture 70 and carrier 28' is slid towards the other drilled hole until pin 24' is entirely inserted therein. Next, thumb screw 26' is tightened thereby keeping rail assembly 20 suspended above the building aperture.

In order to secure bottom rail assembly 30 to aperture 70, a user must first drill holes on the opposing frame sides S of aperture 70. These holes will cooperatively receive pin members 54 and 54'. The best way to install bottom rail assembly 30 is to pre-set carrier 50 along member 35 and adjust carrier 50 so that pin member 54 is entirely inserted into one of the holes drilled in the lower section of the aperture 70 frame. Then, elongated flat bar member 31 is brought flush against the lower exterior face of aperture 70 and carrier 50' is slid towards the other drilled hole until pin 54' is entirely inserted therein. Next, thumb screw 56' is tightened thereby keeping rail assembly 30 suspended at the foot of aperture 70.

After a user installs assemblies 20 and 30, he then installs shutter member 40 by bringing the upper edge of shutter member 40 inside top rail assembly 20 and the lower edge of shutter 40 is slid towards bottom rail assembly 30 until the bottom edge of shutter 40 rests on elongated punched flat bar member 33 and abuts the exterior face of bottom rail assembly 30. Shutter pins 60 are then inserted into punched holes 32 of elongated punched flat bar member 33 in order to secure shutter 40 to aperture 70.

As explained above, top and bottom rail assemblies 20 and 30 are installed with pins 24, 24', 54 and 54' in holes that are drilled in the opposing frame sides S of aperture 70. This means that the exterior wall surrounding aperture 70 is not disfigured because no holes are drilled into it. The holes drilled on sides S are not readily noticeable unless a close inspection is undertaken. This represents a significant improvement over the prior art.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shutter system for protecting building apertures having opposing frame sides including:

A. an elongated top rail means including an elongated channel member having first, second and top elongated side wall members and said first and second elongated side wall members kept parallel and spaced apart from one another by said elongated top wall member, and said elongated top rail means further including an elongated first guide member rigidly mounted to said second elongated side wall member;

B. first top sliding carrier means including a first guide slot which cooperatively and slidably receives said first guide member and further including means for attaching said first top sliding carrier means to the frame side of said aperture;

C. second top sliding carrier means including a second guide slot which cooperatively and slidably receives said first guide member and further including means for attaching said second top sliding carrier means to the frame side of said aperture;

D. elongated bottom rail means including a first elongated flat bar member having first and second sides, a second elongated flat bar member with punched holes and said second elongated flat bar member being mounted perpendicular to said first elongated flat bar member along the entire length of the first side of said first elongated flat bar member, and an elongated second guide member rigidly mounted to the second side of said first elongated flat bar member;

E. first bottom sliding carrier means including a third guide slot which cooperatively and slidably receives said second guide member and further including means for attaching said first bottom sliding carrier means to the frame side of said aperture;

F. second bottom sliding carrier means including a fourth guide slot which cooperatively and slidably receives said second guide member and further including means for attaching said bottom sliding carrier means to the frame side of said aperture;

G. a shutter cover means mounted between said top and bottom rail means; and

H. means for securing said cover means against said bottom raft means.

2. The shutter system set forth in claim 1 wherein the first means for attaching said first and second top sliding carrier means each include a first pin member, said first pin members extending parallel and in a spaced apart relationship to said second elongated side wall where said first and second top sliding carrier means are mounted to said guide member and said frame sides include cooperating holes for receiving said first pin members.

3. The shutter system set forth in claim 2 wherein a plurality of top sliding means each including a first vertical pin member, said first vertical pin members extending parallel and in a spaced apart relationship to said second elongated side wall where said plurality of carrier means are mounted to said guide member and said top and bottom frame sides include cooperating holes for receiving said vertical pin members.

4. The shutter system set forth in claim 3 wherein said first and second bottom sliding carriers each include second pin members, said second pin members extending parallel and in a spaced apart relationship to the second side of said first elongated flat bar member.

5. The shutter system set forth in claim 4 wherein a plurality at bottom sliding carriers each including second vertical pin members said second vertical pin members extending parallel in a spaced apart relationship to the second side of said first elongated flat bar member.

6. The shutter system set forth in claim 5, wherein said first and second top and bottom carrier means each include means for securing them in place with respect to said first and second guide members to which they are slidably mounted.

7. The shutter system set forth in claim 6, wherein said first and second guide members have a T-shape and said first, second, third and fourth guide slots also have a T-shape to slidably receive said T-shaped guide members.

8. The device set forth in claim 7, wherein said means for securing said cover means against said bottom rail means includes a plurality of shutter pin members that removably and partially inserted in said punched holes.

* * * * *